US005243958A

United States Patent [19]

Shepleym, Jr.

[11] Patent Number: 5,243,958

[45] Date of Patent: Sep. 14, 1993

[54] ARCHERY BOW WITH LATERALLY ADJUSTABLE GRIP

[75] Inventor: Paul E. Shepley, Jr., Tucson, Ariz.

[73] Assignee: Precision Shooting Equipment, Inc., Tucson, Ariz.

[21] Appl. No.: 881,196

[22] Filed: May 11, 1992

Related U.S. Application Data

[63] Continuation-in-part of Ser. No. 818,616, Jan. 8, 1992.

[51] Int. Cl.[5] ..... F41B 5/00

[52] U.S. Cl. ..... 124/88; 124/23.1

[58] Field of Search ..... 124/23.1, 24.1, 20.1, 124/25.6, 86, 88

[56] References Cited

U.S. PATENT DOCUMENTS

| | | | |
|---|---|---|---|
| 2,900,973 | 8/1959 | Diehr | 124/23.1 |
| 3,055,353 | 9/1962 | Perrucci | 124/24.1 |
| 3,176,674 | 4/1965 | Smith | 124/23.1 |
| 3,407,799 | 10/1968 | Reynolds | 124/24 |
| 3,537,439 | 11/1970 | Joslin | 124/24.1 |
| 4,124,014 | 11/1978 | Darlington | 124/88 |
| 4,175,536 | 11/1979 | Carella | 124/23.1 |
| 4,252,100 | 2/1981 | Rickard | 124/23.1 |
| 4,457,287 | 7/1984 | Babington | 124/23.1 |
| 4,966,124 | 10/1990 | Burling et al. | 124/23.1 |
| 5,081,979 | 1/1992 | Burling | 124/23.1 |

*Primary Examiner*—Randolph A. Reese
*Assistant Examiner*—John Ricci
*Attorney, Agent, or Firm*—Cahill, Sutton & Thomas

[57] ABSTRACT

In an archery bow having a central riser and a separate grip, the grip is made adjustable from side to side by making the width of the channel down the back of the grip greater than the thickness of the riser. The grip is adjusted from side to side by spacers or shims located between one side of the riser and the grip or by adjusting screws on opposite sides of the grip. Since the hand of the archer extends around both the grip and the riser, as the grip is moved to the side, the effect is a rotation of the archer's hold on the bow without actually rotating the grip.

15 Claims, 2 Drawing Sheets

ARCHERY BOW WITH LATERALLY ADJUSTABLE GRIP

CROSS-REFERENCE TO RELATED APPLICATION

This application is a continuation-in-part of application Ser. No. 07/818,166, filed Jan. 8, 1992, and is assigned to the assignee of the prior application.

BACKGROUND

This invention relates to archery bows and, in particular, to a laterally adjustable grip for an archery bow.

Whether hunting or target shooting, an archer strives to develop a consistent form to achieve accuracy with each shot. Various sights, counterweights, and other accessories are available to help the archer achieve this purpose. One item, which is on every bow, that is often overlooked is the grip. A grip is typically a wooden or plastic piece which is curved or shaped to fit the hand of the archer. The grip may be formed as part of the bow itself or be a separate piece. For what is known as a compound bow, the grip is typically a separate piece which straddles the riser, the central portion of a compound bow.

Seen from above, an archer holding a bow at full draw forms a triangle. The arrow is one side of the triangle, extending from the archer's hand (or release mechanism) to the rest, which is attached just above the grip. The archer's arm is the second side of the triangle. The archer's torso forms the third side of the triangle. The angle between the arm of the archer and the arrow depends on the archer's style, the draw length of the bow, and the size of the archer.

A riser typically comprises aluminum or other light metal or alloy and is wider front to back (in the direction of the arrow) than it is from side to side. The grip is aligned with the riser, i.e. with the arrow, not with the archer's arm. The archer thus holds the grip slightly turned in his hand or else bends his wrist backward slightly to hold the grip squarely. Since a bent wrist is weaker than a straight wrist, an inconsistency can occur as the archer changes his hold on the bow either through fatigue or lack of concentration or as the archer rotates the bow as the arrow is released.

Adjustable grips are known in the prior art and generally fall into one of two types. The first type is a grip that is adjustable front to rear, in the direction of the arrow. U.S. Pat. No. 4,175,536 discloses a grip of this type. The second type is a grip that is connected to the riser by a ball and socket joint. U.S. Pat. No. 3,407,799 discloses a grip of the second type. While permitting the grip to rotate in several directions, the second type of grip concentrates the draw force in the ball and socket joint and is difficult to position consistently.

In view of the foregoing, it is therefore an object of the invention to provide an improved ergonomic grip for archery bows.

Another object of the invention is to provide a laterally adjustable grip.

A further object of the invention is to provide a grip which couples the draw force over substantially its entire length to the riser.

SUMMARY OF THE INVENTION

The foregoing objects are achieved by the invention in which a laterally adjustable grip has a central channel wider than the riser. The grip straddles the riser with the bottom of the channel resting on the back of the riser. Screws passing through the grip and threaded into the riser hold the grip in place from side to side. In one embodiment of the invention, spacers between the side of the grip and the riser enable an incremental adjustment of the grip. In an alternative embodiment of the invention, a pair of screws on opposite sides of the grip engage a threaded insert in the riser for continuous adjustment the grip.

It has been found that, unlike grips using ball and socket joints, it is not necessary for the grip to rotate in order to adjust the grip on a bow to suit the archer. Specifically, it has been found that laterally adjusting the grip provides sufficient adjustment for the archer to consistently hold the bow before, during, after release of the arrow. This not only simplifies construction of the grip but also provides a stronger grip since the grip rests on the back of the riser and is firmly attached to the riser at two, spaced apart locations along the riser.

A more complete understanding of the invention can be obtained by considering the following detailed description in conjunction with the accompanying drawings in which.

DETAILED DESCRIPTION

Figure 1:
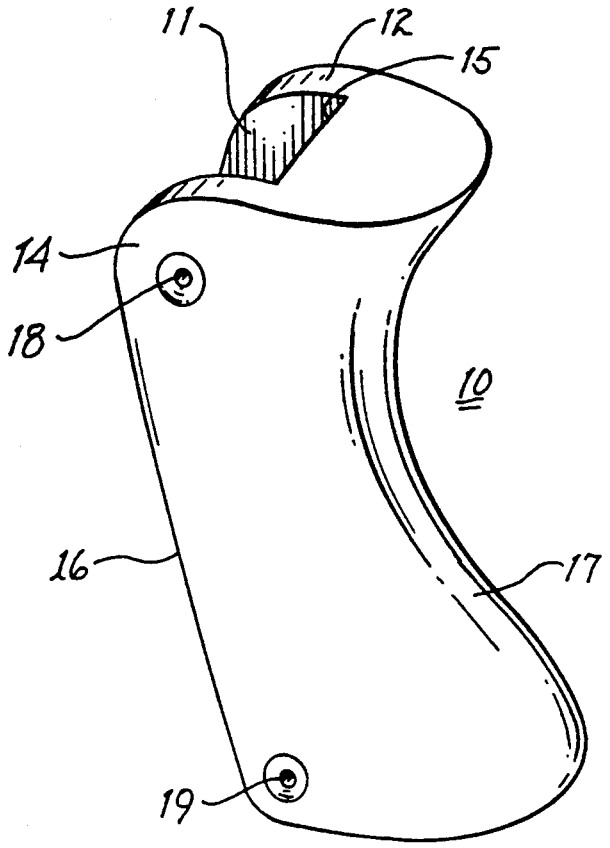
FIG. 1 illustrates a grip constructed in accordance with the invention.

FIG. 1 illustrates a grip in accordance with the invention which can be made from metal, plastic, or wood. Grip 10 has central channel 11 formed in the front surface thereof, running from the top to the bottom of the grip as illustrated in FIG. 1. Channel 11 is defined by side walls 12 and 14 and surface 15. Unlike grips of the prior art, channel 11 is wider than the portion of the riser where grip 10 is attached. This enables grip 10 to move from side to side on the riser.

Figure 3:
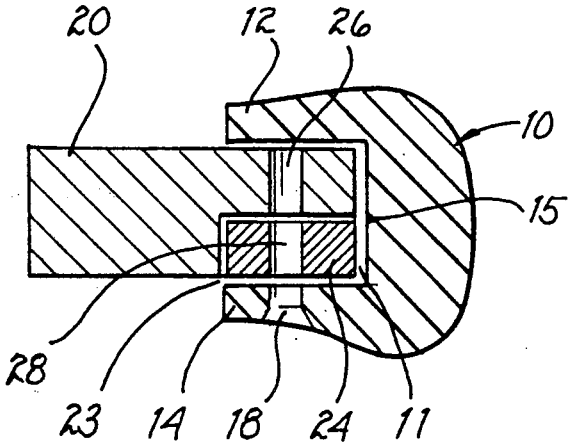
FIG. 3 is a cross-section of the riser of a bow through the section line indicated in FIG. 2.

Front edge 16 is slanted to match the angle of the riser, while back surface 17 is contoured to fit comfortably in the palm of the hand. Surface 15 preferably rests on the back of the riser, as shown in FIG. 3. Countersunk bores 18 and 19 provide clearance for a pair of flathead screws (not shown) which attach grip 10 to a riser.

Figure 2:
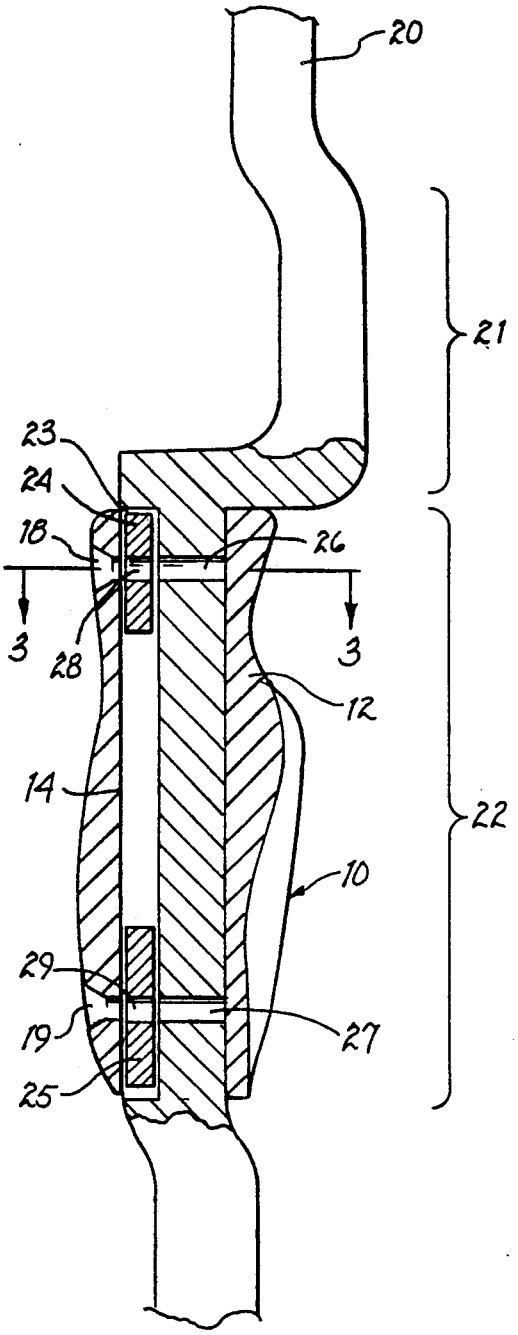
FIG. 2 illustrates in partial cross section a grip laterally adjustable on a riser by spacers.

FIG. 2 illustrates the central portion of a righthanded compound bow as seen by the archer. Specifically, riser 20 includes offset portion 21 and handle portion 22. Offset portion 21 provides clearance for the tip and fletching of a hunting arrow, or the fletching of a target arrow, and can have any one of a variety of arrow rests attached thereto for locating the arrow above grip 10.

Handle portion 22 has a reduced thickness section or recess 23 formed in the left-hand side thereof. Grip 10 straddles handle portion 22 and side wall 14 is shaped to fit within recess 23. Washers 24 and 25 separate side wall 14 from handle portion 22. Bores 26 and 27 in handle portion 22 align with bores 18 and 19 in grip 10. Similarly, bores 28 and 29 in washers 24 and 25 align with bores 18 and 19 in grip 10. Bores 26 and 27 are threaded. Flathead screws (not shown) pass through the bores in the grip and the washers and engage bores 26 and 27 to fasten grip 10 and the washers to riser 20.

The depth of recess 23 is not critical. A depth of 0.25 inches (6 mm) has been found effective. As illustrated in FIG. 2, washers 24 and 25 have approximately the same thickness as the depth of recess 23, which locates grip 10 in its left-most position. Thinner washers locate grip 10 further to the right and the absence of washers locates grip 10 at its right most position. Several thinner washers can be used instead of a single, thicker washer. The washers are preferably made from plastic although metal washers can be used. Since the bow may be used outdoors in inclement weather, brass washers are preferred to steel washers for their resistance to corrosion.

FIG. 3 illustrates a cross section through section line 3—3 of FIG. 2. Side walls 12 and 14 of channel 11 straddle riser 20. Located between side wall 14 and riser 20 is washer 24 fitting within recess 23. The components are shown more loosely spaced in FIG. 3 than they are in practice. Surface 15, for example, preferably rests against riser 20 along the length of grip 10 to stabilize the grip.

Figure 4:
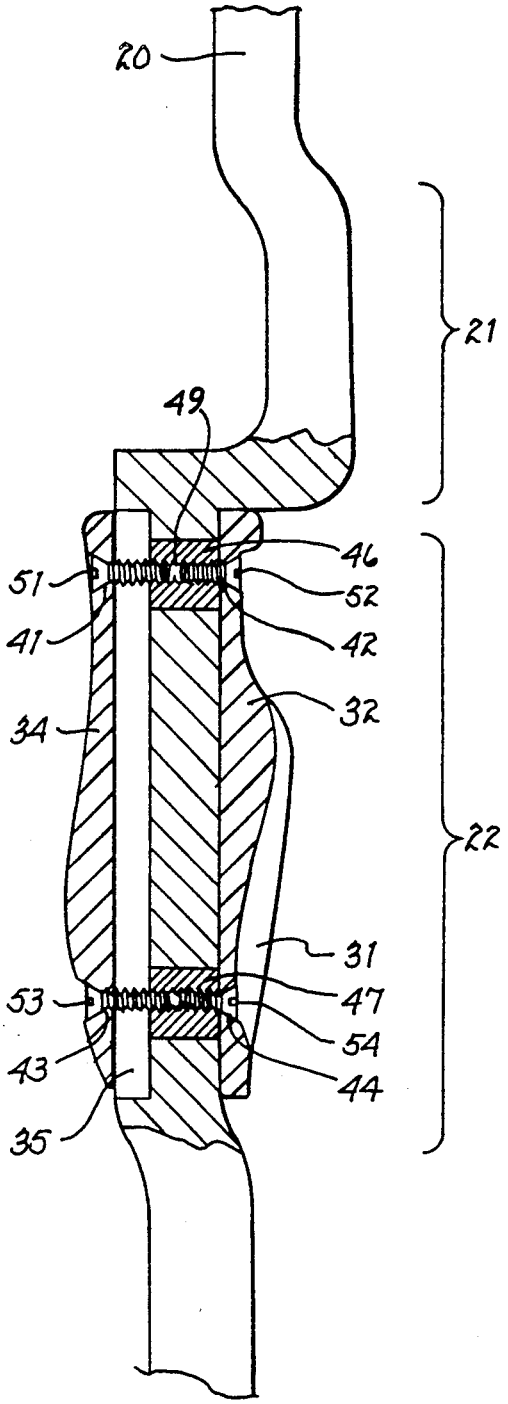
FIG. 4 illustrates in partial cross-section a grip laterally adjustable on a riser by opposing screws engaging an insert in the riser.

The use of washers provides an incremental adjustment of the grip and includes several separate pieces. FIG. 4 illustrates an alternative embodiment of the invention which enables a continuous adjustment of the position of the grip. Grip 31 straddles handle portion 22 and is at its left-most position, with side wall 32 resting against handle portion 22. Side wall 34 does not touch handle portion 22 but is separated from it by space 35.

Bores 41–44, through the side walls of grip 31, are each countersunk to provide an opening taper. Grip 31 is held in place laterally by screws 51–54, each of which is a flathead screw fitting within a bore in grip 31. Although the handle portion itself could have threaded bores aligned with the countersunk bores in handle 31, it is preferred that internally threaded inserts 46 and 47 be provided for receiving screws 51–54 respectively. Inserts 46 and 47 are made from a harder material than riser 20, such as brass or steel, so that there is less chance of the threads becoming stripped. Inserts 46 and 47 can be press fit, threaded, or attached with adhesive to riser 20.

To move grip 31 to the right, screws 52 and 54 are loosened the desired amount and then screws 51 and 53 are tightened. To move grip 31 to the left, screws 51 and 53 are loosened the desired amount and then screws 52 and 54 are tightened. In general, the screws are loosened first on the side towards which the grip is to move.

The opposed screws, i.e. the screws entering an insert from opposite ends, are not simultaneously fully threaded into the insert. As illustrated in FIG. 4, screw 51 spans space 35 with only the end thereof in insert 46 while screw 52 is threaded into insert 46 as far as it can be. Also, the lengths of the screws are such that there is always a gap, such as gap 49, between the ends of the screws. Because there is a large contact area between the heads of the screws and the countersunk portions of the bores, the screws will not loosen when the bow is fired, which can vibrate the riser considerably.

As with the embodiment shown in FIG. 2, the range of adjustment is equal to the difference between the width of the channel in the grip and the thickness of the handle portion. Although a wider or narrower range of adjustment can be used, a range of 0.25 inches (6 mm) has been found satisfactory.

The hand of the archer extends around both the grip and the riser so that, as the grip is moved to the left, the effect is a rotation of the archer's hold on the bow without actually rotating the grip. Thus, one obtains a more consistent hold on the bow without weakening the structure of the bow by having a rotating grip.

Having thus described the invention, it will be apparent to those of skill in the art that various modifications can be made within the scope of the invention. For example, the recess is preferably formed in only one side of the riser to reduce the time and cost of machining the riser. One can form the recess on either or both sides of the riser. For thinner risers, or thicker grips, the recess can be omitted. While it is preferred that the spacers are washers, the spacers can be one or more thin sheets fitting within the recess to achieve lateral adjustment of the grip. Although described in conjunction with a riser for a compound bow, the invention can be applied to all types of bows.

I claim:

1. An archery bow having a central portion adapted to be gripped by an archer, the bow comprising:

a handle portion having a width from front to rear greater than the thickness of said handle portion from side to side;

a grip having a pair of side walls defining a channel extending the length of said grip and having a contoured back opposite said channel, wherein the distance between said side walls is greater than the thickness of said handle portion and said grip can move from side to side while straddling said handle portion;

fastening means connecting said handle portion and at least one of the side walls of said grip for maintaining said grip at a predetermined lateral position relative to said handle portion.

2. The archery bow as set forth in claim 1 wherein said handle portion includes a recess in one side thereof for receiving said grip.

3. The archery bow as set forth in claim 2 wherein said fastening means includes one or more spacers located in said recess between said handle portion and said grip.

4. The archery bow as set forth in claim 3 wherein said spacers are washers.

5. The archery bow as set forth in claim 3 and further comprising a screw for attaching said spacers to said grip and to said handle portion.

6. The archery bow as set forth in claim 1 wherein each side wall includes a pair of bores spaced along the length of said grip, each of said bores having a tapered opening, said handle portion includes a pair of threaded inserts aligned with the bores in said side walls, and said fastening means includes two pairs of screws, a first pair of screws engaging one of said threaded inserts through said side walls and a second pair of screws engaging the other of said threaded inserts through said sidewalls.

7. The archery bow as set forth in claim 6 wherein said fastening means comprises flathead screws.

8. The archery bow as set forth in claim 1 wherein the bottom of said channel rests on the back of said handle portion.

9. In an archery bow having a riser including a handle portion having a width from front to rear greater than a thickness from side to side and a grip straddling said thickness,the improvement comprising:

said grip having a channel whose width is greater than said thickness by a predetermined distance; and adjusting means attaching said grip to said handle portion, for moving said grip from side to side an amount equal to or less than said predetermined distance.

10. The archery bow as set forth in claim 9 wherein said adjusting means is incrementally variable.

11. The archery bow as set forth in claim 10 wherein said adjusting means includes washers having a thickness equal to or less than said predetermined distance.

12. The archery bow as set forth in claim 11 wherein said adjusting means is continuously variable.

13. The archery bow as set forth in claim 12 wherein said handle portion includes a threaded bore and said adjustment means comprises a pair of opposed screws engaging said threaded bore.

14. The archery bow as set forth in claim 13 wherein said handle portion includes an insert and said threaded bore is in said insert.

15. The archery bow as set forth in claim 9 wherein the bottom of said channel rests on the back of said handle portion.

* * * * *